United States Patent [19]

Cooper

[11] 4,322,924

[45] Apr. 6, 1982

[54] ROOF RIDGE CAPPING

[75] Inventor: Christopher A. Cooper, Sittinghurst, England

[73] Assignee: Marley Tile AG, Zug, Switzerland

[21] Appl. No.: 951,300

[22] Filed: Oct. 13, 1978

[51] Int. Cl.[3] ..... E04B 7/00

[52] U.S. Cl. ..... 52/57; 52/462; 52/465

[58] Field of Search ..... 52/57, 462, 461, 547, 52/551, 550, 464, 465, 199, 542

[56] References Cited

U.S. PATENT DOCUMENTS

| | | | |
|---|---|---|---|
| 1,653,847 | 12/1927 | Greenstreet . | |
| 1,861,998 | 6/1932 | Bennett | 52/542 X |
| 3,073,235 | 1/1963 | Smith et al. . | |
| 4,015,374 | 4/1977 | Epstein et al. | 52/57 |
| 4,024,685 | 5/1977 | Aarons | 52/57 X |

FOREIGN PATENT DOCUMENTS

| | | | |
|---|---|---|---|
| 844260 | 6/1970 | Canada | 52/57 |
| 1949035 | 4/1971 | Fed. Rep. of Germany | 52/57 |
| 682086 | 11/1952 | United Kingdom . | |

*Primary Examiner*—Price C. Faw, Jr.
*Assistant Examiner*—Carl D. Friedman
*Attorney, Agent, or Firm*—Bacon & Thomas

[57] ABSTRACT

An elongate roof ridge capping member for a tiled roof includes a pair of longitudinally extending flanges interconnected by a capping section. The capping section is connected to at least one of the flanges by a re-entrant portion, being so connected to both flanges in the case of a member for a duo-pitch roof. The re-entrant portion defines a longitudinally extending recess which can receive the end of a roof tile. The flange in the recess is provided with a longitudinal ridge or the like which inter-engages with the nib of the tile to hold it in position. Filler units may be used to provide weathering of tiles with profiled upper surfaces.

11 Claims, 11 Drawing Figures

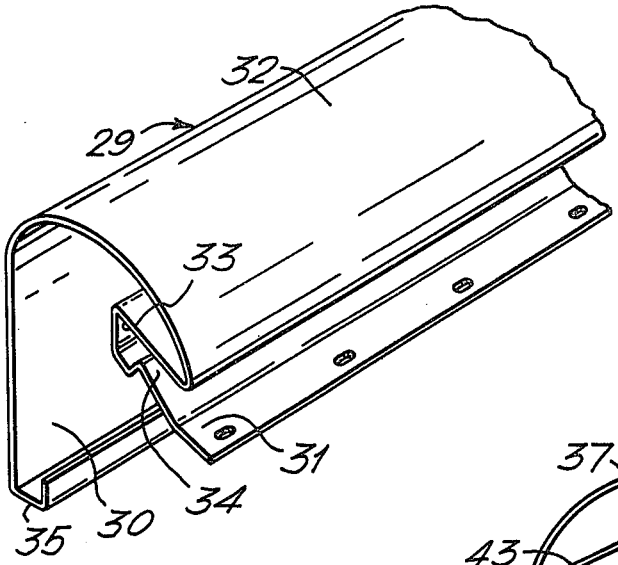
FIG.6.
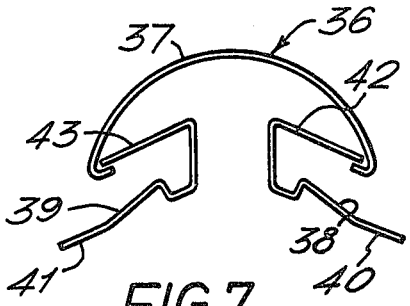
FIG.7.
FIG.8.
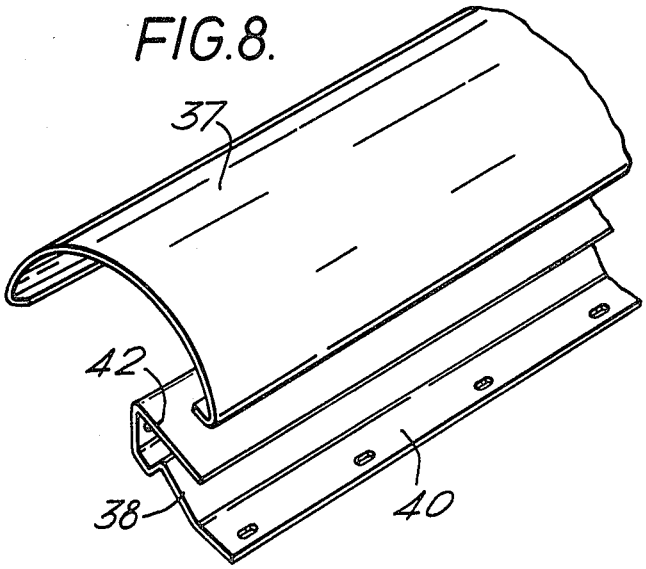

FIG.9.
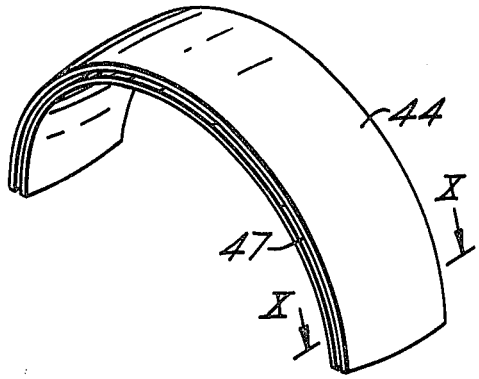
FIG.10.
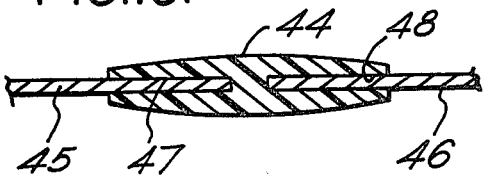
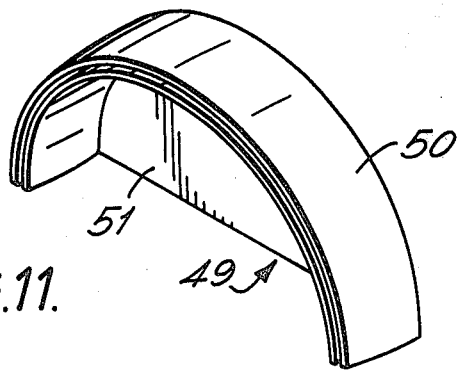
FIG.11.

ROOF RIDGE CAPPING

This invention relates to the capping of roof ridges.

Heretofore tiled roofs have had their ridges capped by means of purpose-made ridge tiles, for example of concrete or clay, which are bedded with mortar onto the roof tiles. Although such a system is reasonably flexible, it has several disadvantages. One of these is that skilled labour is necessary and the capping operation may be fairly lengthy. Furthermore, substantial quantities of mortar may be required and even with skilled labour there is a possibility of an undulatory finish.

The security of the ridge tiles also presents problems, since after a certain period the mortar may crack and the tile become loose. In some arrangements additional fixing means are employed.Not only does this add to the complexity of the ridge-capping operation, but it may not be suitable for use in some recent roof constructions which do not employ a ridge board. The security of the top layer of roofing tiles is also important and frequently these have to be attached to battens by nails or purpose-made clips.

There has been proposed a system employing tapered ridge tiles which overlap, the complete assembly being nailed or stuck to the roof, without the use of mortar. This though still requires too much labour time and employs too many components.

According to the invention there is provided an elongate roof ridge-capping member comprising a pair of longitudinally extending flanges interconnected by a capping section, said capping section being connected to at least one of said flanges by a re-entrant portion defining with the said at least one flange a longitudinally extending recess, said at least one flange being provided with a longitudinally extending abutment surface facing into said recess.

With such a ridge capping member, the member can be secured to roof rafters by for example nails passing through the flanges, thus eliminating the need for mortar. Furthermore, roof tiles can be located in the recess, their nibs engaging over the abutment surface, thus eliminating the need for top course tiling battens.

Where the capping member is intended for use on a duo-pitch roof, the capping section will be connected to each flange by a re-entrant portion, and each flange will have an abutment. On the other hand, when intended for use on a mono-pitch roof, the capping section need only be connected to one flange by a re-entrant portion.

To enable the capping member to be used on roofs with different pitches, within certain limits, it is desirably made of a somewhat flexible or semi-rigid material such as plastics or sheet steel—which could be covered with P.V.C. The flexibility of the capping member can be used to advantage by allowing for a tile to be clamped in place and firmly located with its nib against the abutment surface and also enables a variety of standard shapes of tile to be accommodated.

It will be appreciated that whether or not a suitable clamping action can be achieved will depend on the relative dimensions of the recess and the tile to be located in it. In cases where the tile is too thin for a particular capping member, or where it has an unsuitable profile, a filler unit can be used. This filler unit may for example be an elongate member of substantially U-section, having two flanges interconnected by a substantially flat portion. The filler could be located in the recess by any suitable means, but in a particularly advantageous arrangement one flange rests on the surface of the tile, and the other is located behind the back of the tile. The flange resting on the tile surface may be profiled to match the profile of a tile with which it is to be used. By means of such fillers a standard capping member according to the invention can be used with a greater variety of shapes and/or sizes of tiles. The fillers may be made of any suitable rigid or semi-rigid material, e.g. plastics.

The recess in the capping member is effectively weathered and thus ventilation slots or holes may be provided in this region, to reduce the effects of condensation in the roof space. Such slots or holes could be drilled, or where the capping member is rolled sheet steel could be cropped, and may be for example in the upright portion at the base of the recess, or in the top of the recess.

Fixing of the capping member by e.g. nails may be facilitated by holes spaced along the flanges.

The positive fixing of the flanges to roof timbers on either side of the capping member adds strength and rigidity to a roof.

The capping member may be of any suitable length, but to reduce the number of operations required to cap a roof it may be about 5–6 meters long: this will avoid the need for too many joints and the member can simply be trimmed to the correct length. When it is necessary to join lengths, this can be done by suitable unions, made for example of P.V.C. The ends of the capping member can be closed by any suitable means, for example by the use of a purposemade end cap.

The ridge capping member may be of one piece, or could comprise two or more components. In one suitable arrangement the member comprises a capping section and two separate elements each carrying a flange and the major part of a re-entrant portion.

Some embodiments of the invention will now be described by way of example and with reference to the accompanying drawings, in which:

FIG. 6 is a perspective view of a ridge capping member for use with a mono-pitch roof;

FIG. 7 is a section of a three-component ridge capping member in accordance with the invention;

FIG. 8 is a perspective view of the capping section and one flange carrying element of the member of FIG. 7;

FIG. 9 is a perspective view of a union for joining two ridge capping members;

FIG. 10 is a section through the union of FIG. 9, showing two capping members in place; and FIG. 11 is a perspective view of an end cap for use with a ridge capping member in accordance with the invention.

Figure 1:
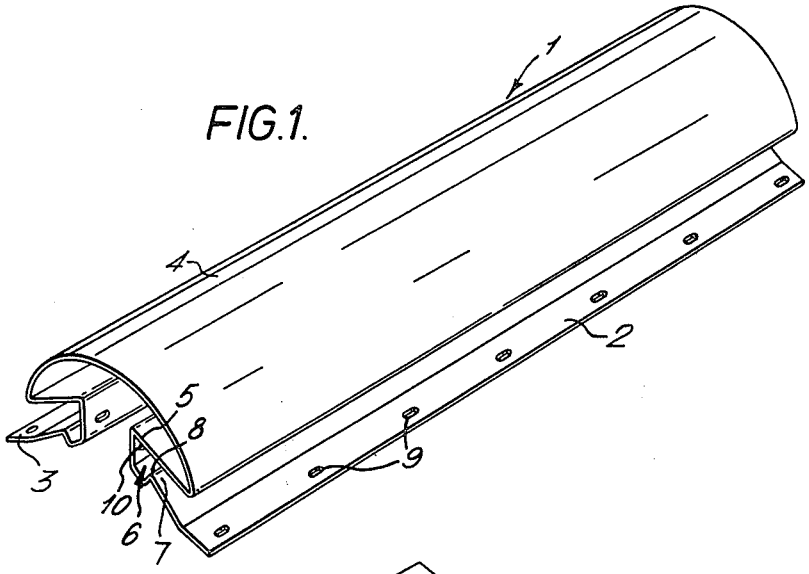
FIG. 1 is a perspective view of a ridge capping member in accordance with the invention, for use on a duo-pitch roof.

Referring now to the drawings, there is shown a ridge capping member 1, having two longitudinally extending flanges 2 and 3 on opposite sides thereof, interconnected by a capping section 4. Considering only the junction of the capping section to the flange 2, this is by means of a re-entrant portion 5 which forms with the flange 2 a recess indicated generally at 6. The flange 2 has a longitudinally extending upstand 7 which forms an abutment surface 8 facing into the recess. Fixing holes 9 are spaced at regular intervals along the flange, and a ventilation aperture 10 is provided in the upright of the re-entrant portion. Flange 3 is similarly constructed and connected to the capping section 4. The complete capping member is made e.g. from P.V.C. covered rolled steel, so as to be flexible whereby the angle between the flanges 2 and 3 can be varied as required.

Figure 2:
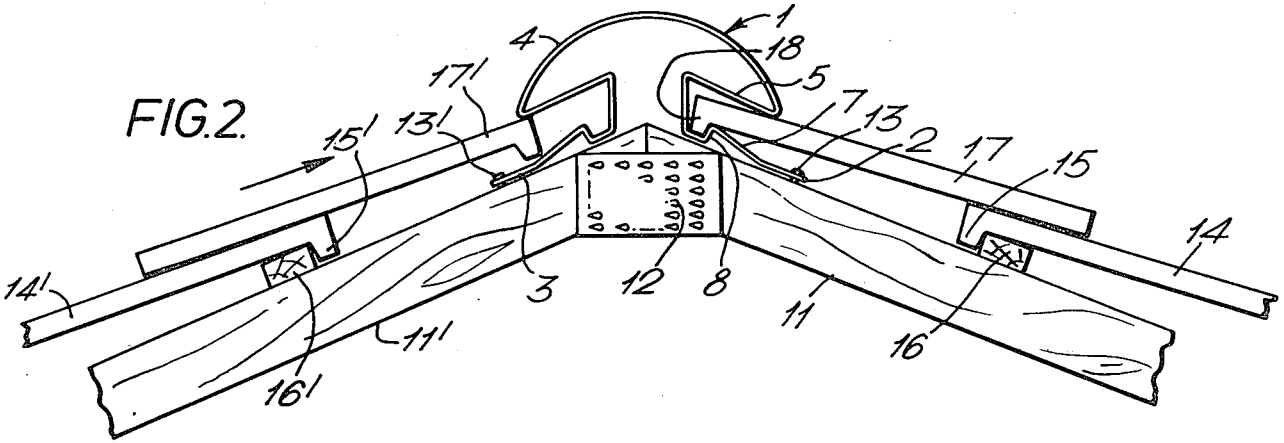
FIG. 2 is an end elevation of the capping member of FIG. 1 in position on a roof.

FIG. 2 shows a pair of roof rafters 11 and 11' joined at 12 to form the ridge of a duo-pitch roof. To the rafters has been nailed the ridge capping member 1, at 13 and 13', this being done after the roofing felt (not shown) has been laid, for example when nailing roof battens in place. Conventional roofing tiles 14 and 14' are laid in place in the normal manner, with their nibs 15 and 15' engaging over roof battens 16 and 16' respectively. These tiles may for example be nailed or clipped in place to the battens in the known manner.

On the left hand side, a top tile 17' is shown being pushed in the direction of the arrow into engagement with the capping member. As shown with reference to tile 17 on the right hand side, this occurs when the nib 18 rides over the upstand 7 and engages with the abutment surface 8. The resilience of the material of the capping member enables the re-entrant portion 5 to bear down on the surface of the tile and clamp it in place. The curved capping portion 4 acts as a spring in this regard. The re-entrant portion overlaps the tile by approximately 3 inches to provide the correct location of the tile and weathering.

Figure 4:
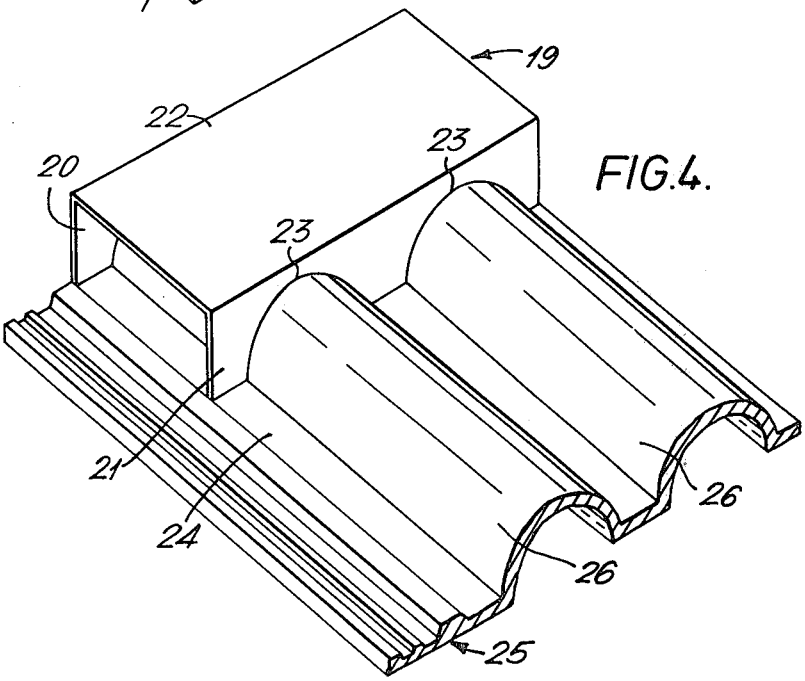
FIG. 4 is a perspective view of the filler unit of FIG. 3 in position on a tile.
Figure 3:
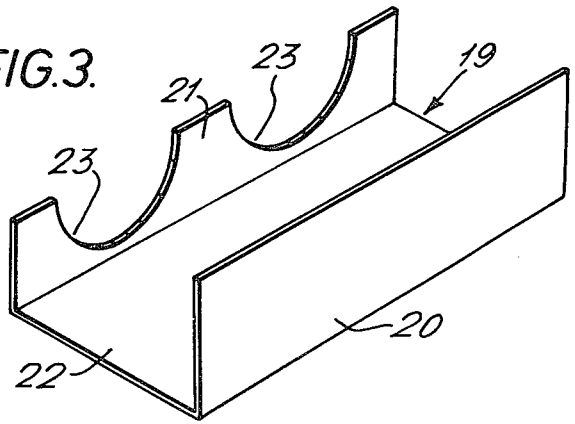
FIG. 3 is a perspective view of a filler unit for use with a profiled tile.

FIG. 3 shows a filler unit 19 for use with the capping member 7 when profiled tiles are employed. This filler unit 19 is substantially U-shaped, having two longitudinally extending flanges 20 and 21 interconnected by a flat portion 22. The flange 21 has cut-outs 23 so that it can rest on the surface 24 of a tile 25, as shown in FIG. 4, with the cut-outs receiving the profiles 26 of the tile. The flange 20 is longer than the flange 21 so that it locates behind the back surface of the tile when it is positioned in the recess 6 of the capping member shown in FIGS. 1 or 2. The filler unit 1 provides correct weathering, and also enables the re-entrant portion 5 resiliently to bear down on the tile 25 over its width, and securely locate it in position.

Figure 5:
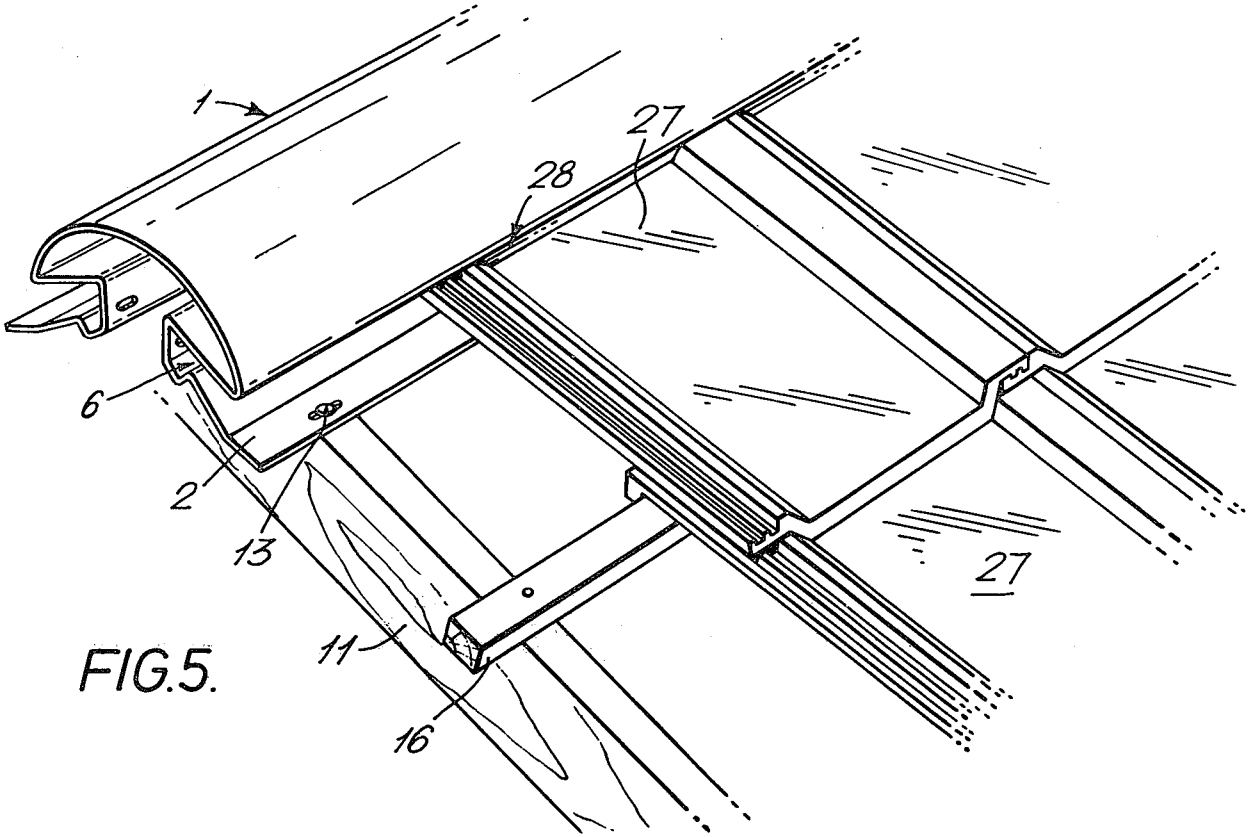
FIG. 5 is a perspective view of the ridge capping member of FIG. 1 attached to roof rafters, with a second type of profiled tile in position together with a filler unit.

FIG. 5 shows the capping member 1 of FIGS. 1 and 2 nailed to a rafter 11 at 13. The roofing felt which would be positioned under the capping member flange 2 and the batten 16 is not shown. Tiles 27 are shown in position, the top tiles being engaged in the recess 6, and having fillers 28 similar to that shown in FIGS. 3 and 4 but adapted to take into account the different profile of tiles 27.

FIG. 6 shows a ridge capping member 29 for use on a mono-pitch roof. This has two longitudinal flanges 30 and 31 interconnected by a capping section 32. This section 32 is joined to flange 31 by a re-entrant portion 33 in a manner similar to the joining of section 4 to flange 2 in the embodiment of FIG. 1. Flange 31 is provided with an upstand 34 similar to that 7 of the embodiment of FIG. 1. In use, the flange 31 is secured to roof rafters in the same manner as flange 2 in FIG. 2, and tiles are received on this side as previously described. Flange 30 on the other hand is secured to the vertical face of a roof member, as shown a lip 35 preferably being provided to help in this respect. Once again the capping member is made of flexible material to enable the clamping of tiles and the accommodation of different roof pitches.

The ridge capping member 36 shown in FIG. 7 comprises three components, namely a capping section 37 and two flange carrying elements 38 and 39. Each element has a flange, 40 and 41 respectively, and a re-entrant portion 42 and 43. Element 38 with flange 40 is shown in perspective view in FIG. 8. To assemble the ridge capping member, the capping section 37 is connected to the elements 38 and 39 by for example sliding it into position or pushing it down onto the elements to clip it in position.

FIGS. 9 and 10 show a union 44 for joining two ridge capping members 47 and 48. The union, which may for example be of P.V.C., is arcuate, and has a recess 47 and 48 respectively along each edge. These grooves receive the end portions of the ridge capping members 45 and 46, to join them together.

FIG. 11 shows an end cap 49, once again for example of P.V.C. or another suitable material. The cap comprises an arcuate flange 50 adapted to fit over the end region of a capping member, and a wall 51.

What is claimed is:

1. A tiled roof having a plurality of overlapping tiles, said tiles having downwardly projecting nibs adjacent their upper edges, and said tiles extending to a ridge on said roof, the ridge being provided with an elongate capping member comprising a pair of longitudinally extending flanges interconnected by a capping section which is connected to at least one of said flanges by a re-entrant portion defining with the said flange a longitudinally extending recess for receiving the upper edges of the roof tiles, the flange having a longitudinally extending abutment facing upwardly into the recess and over which the nibs are engaged, the nibs and the abutment having surfaces in contact so as to retain the tiles in position.

2. A roof as claimed in claim 1, wherein the capping member is of substantially constant cross-section.

3. A roof as claimed in claim 1, wherein the elongate capping member is resilient and the longitudinally extending flanges are interconnected by a resilient, spring-like capping section such that the resilience of the capping member causes the re-entrant portion to bear down on the tiles and retain them in position.

4. A roof as claimed in claim 1, wherein the abutment surface is integrally formed with the said at least one flange.

5. A roof as claimed in claim 1, wherein the capping section is connected to each flange by a re-entrant portion.

6. A roof as claimed in claim 5, comprising a capping section and two separate elements each carrying a flange and the major part of a re-entrant portion, and being connectible to the capping section.

7. A roof as claimed in claim 1, wherein the capping member is flexible so as to accommodate roofs of different pitch angles.

8. A roof as claimed in claim 1, including a filler unit positioned within the at least one recess, to provide weathering and a clamping action between the member and the surface of a tiles.

9. A roof as claimed in claim 8 wherein the filler unit is an elongate member of substantially U-section, having two flanges interconnected by a substantially flat portion.

10. A roof as claimed as claim 9 wherein one of the flanges of the filler unit is longer than the other.

11. A tiled roof having a plurality of overlapping tiles, said tiles having downwardly projecting nibs adjacent their upper edges, and said tiles extending to a ridge on said roof, the ridge being provided with an elongate resilient capping member comprising a pair of longitudinally extending flanges interconnected by a resilient, spring-like capping section which is connected to at least one of said flanges by a re-entrant portion defining with the said flange a longitudinally extending recess for receiving the upper edges of the roof tiles, the flange having a longitudinally extending abutment facing upwardly into the recess and over which the nibs are engaged, the resilience of the capping member causing the re-entrant portion to bear down on the tiles so as to retain the tiles in position.

* * * * *